United States Patent [19]

Reetz

[11] Patent Number: 4,682,460

[45] Date of Patent: Jul. 28, 1987

[54] OPEN WEB STRUCTURAL SUPPORT MOUNTING BRACKET AND LENGTH ADJUSTABLE WEB MEMBER

[75] Inventor: William R. Reetz, Boise, Id.

[73] Assignee: Trus Joist Corporation, Boise, Id.

[21] Appl. No.: 852,732

[22] Filed: Apr. 16, 1986

[51] Int. Cl.[4] ..... E04H 12/18; E04C 3/292

[52] U.S. Cl. ..... 52/632; 52/645; 52/691; 52/693

[58] Field of Search ..... 52/645, 641, 640, 693, 52/632, 691; 403/374; 248/188.2, 274

[56] References Cited

U.S. PATENT DOCUMENTS

| | | | |
|---|---|---|---|
| 2,793,720 | 5/1957 | Hawes | 52/640 |
| 3,062,340 | 11/1962 | Hunnebeck | 52/641 X |
| 3,209,508 | 10/1965 | Hunnebeck | 52/632 |
| 3,704,846 | 12/1972 | Clark | 248/274 X |
| 4,077,176 | 3/1978 | Bauer | 52/693 |
| 4,114,845 | 9/1978 | Weisenberger | 248/188.2 |

FOREIGN PATENT DOCUMENTS

| | | | |
|---|---|---|---|
| 331145 | 8/1958 | Switzerland | 52/632 |
| 438853 | 12/1967 | Switzerland | 248/188.2 |

*Primary Examiner*—Alfred C. Perham

[57] ABSTRACT

A mounting apparatus including a mounting bracket, for attachment of an open web structural support to an end support such as a support wall enables the upper chord member of the structural support to be mounted flush to the top of a bearing plate on the top of the support wall. The bracket is comprised of an angled plate member which is securable to the bearing plate and includes a chord receiving portion having outwardly extending channel members which receive opposite side edges of the ends of the upper chord member. Adjustable length end web members are connected to the angled plate member to accommodate a change of length of the structural support. An adjustable spacer apparatus is provided in the channel members between the end of the upper chord member and angled plate member for accommodating structural supports of different lengths.

18 Claims, 12 Drawing Figures

FIG. 3
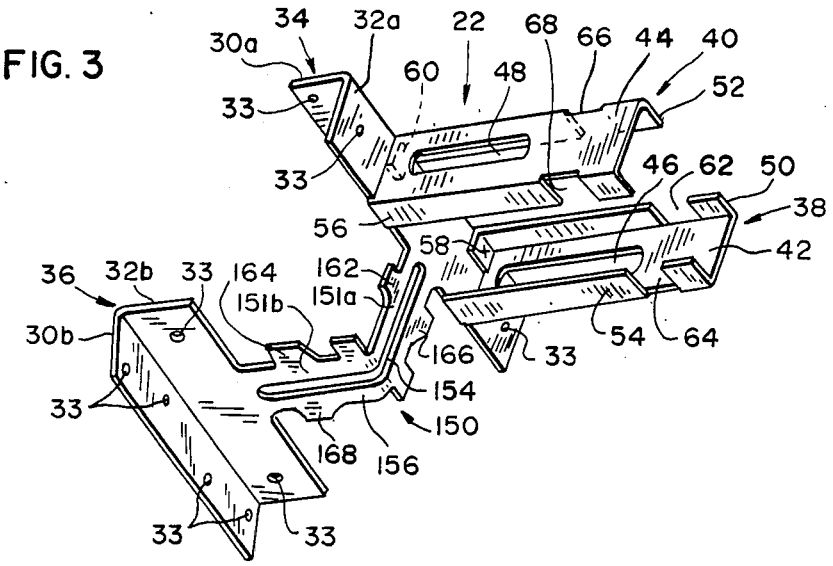
FIG. 4
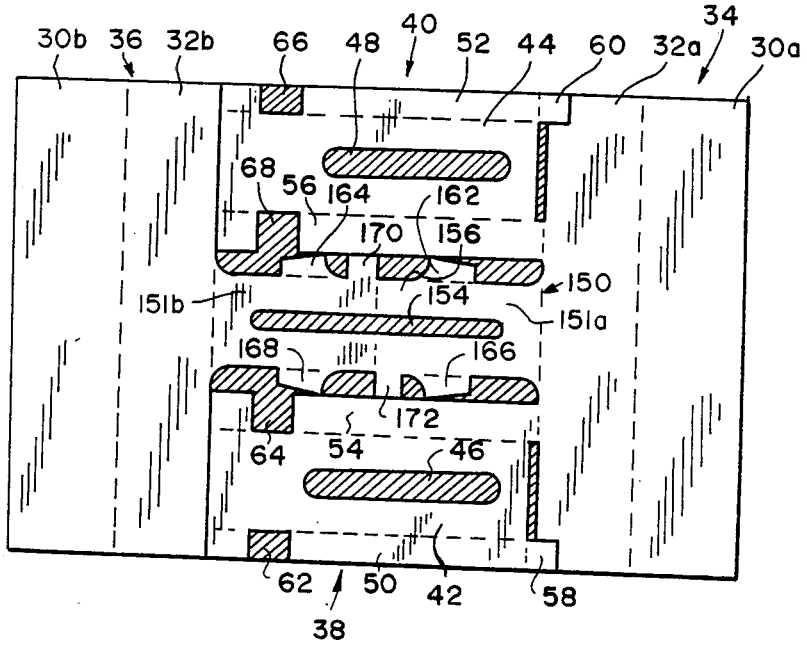
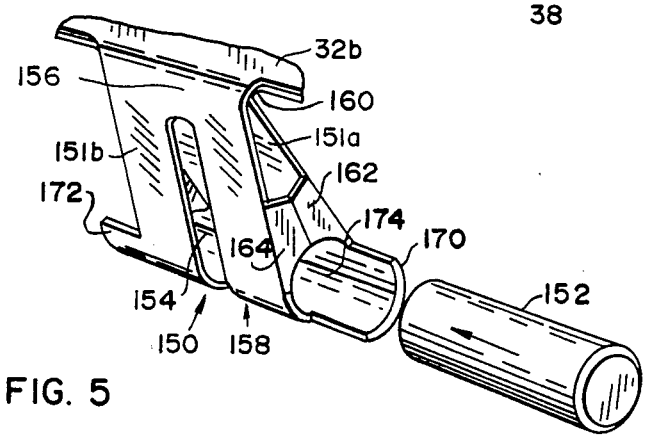
FIG. 5
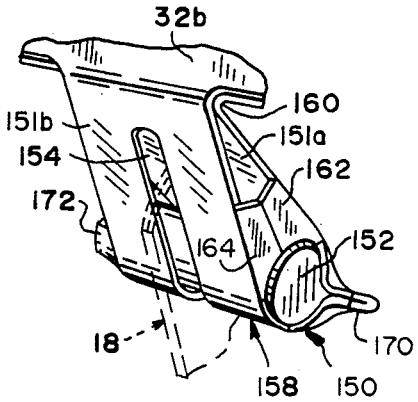
FIG. 6

FIG. 7
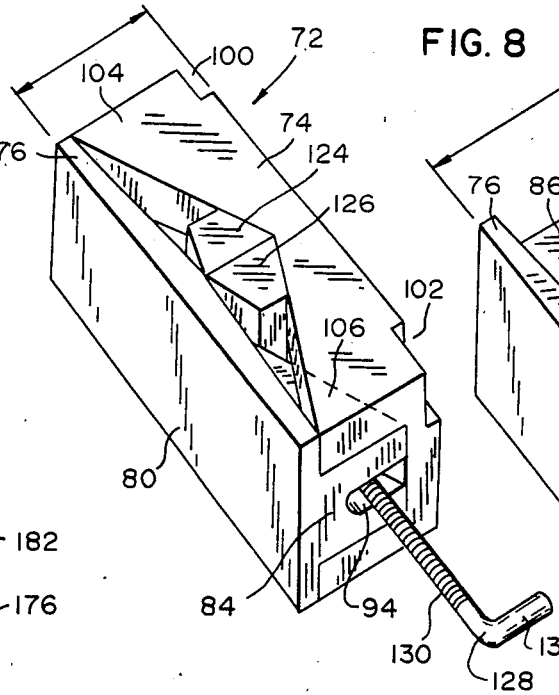
FIG. 8
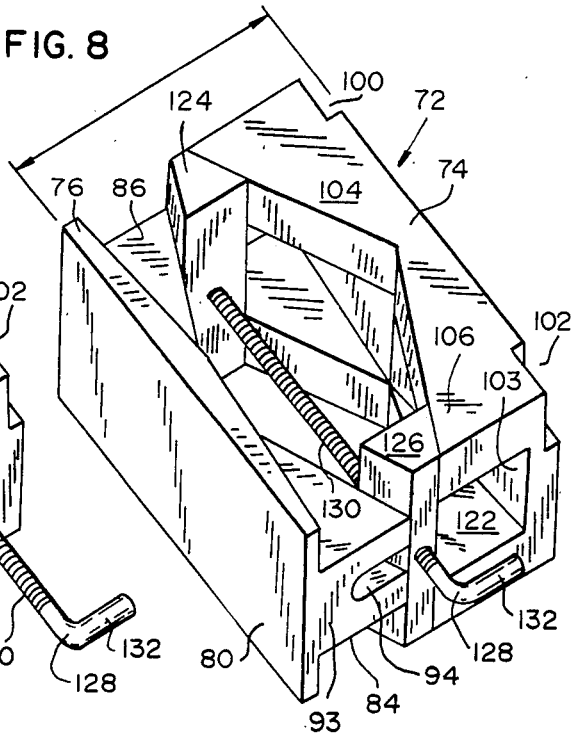
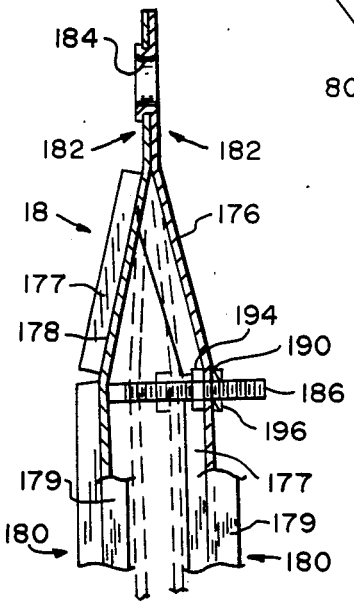
FIG. 12
FIG. 9
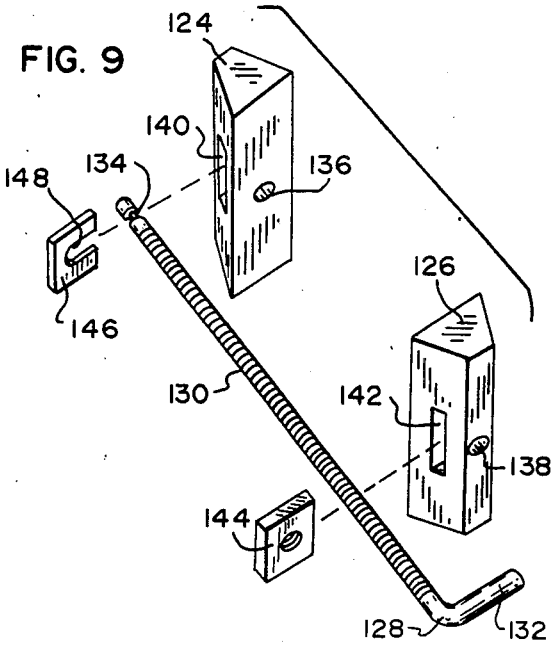
FIG. 10
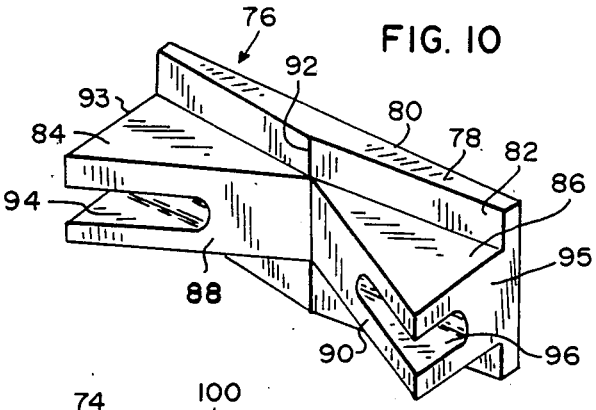
FIG. 11
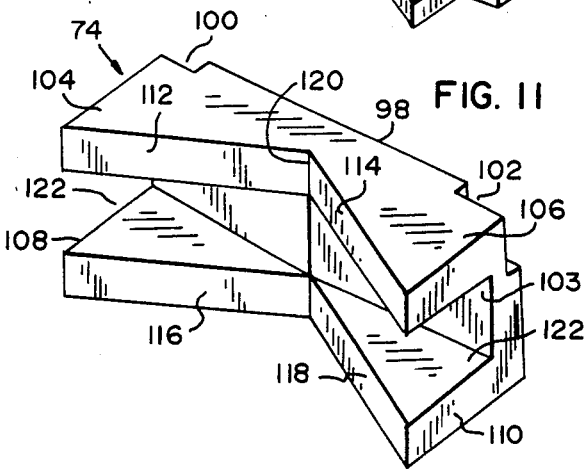

OPEN WEB STRUCTURAL SUPPORT MOUNTING BRACKET AND LENGTH ADJUSTABLE WEB MEMBER

BACKGROUND OF THE INVENTION

This invention relates generally to structural support members of the open web type, such as trusses or joists, and more particularly to the mounting of such support members on end supports such as walls. Open web trusses are commonly mounted on support walls at the opposite ends of the truss upper chord member. The upper chord member is generally longer than the lower chord member and usually mounts to a wood bearing plate fixed to the top of a concrete support wall.

SUMMARY OF THE INVENTION

It is an object of the present invention to enable an open web structural support member such as an open web truss to be mounted flush with the top of an end support such as a wall.

It is another object of the present invention to provide a mounting bracket apparatus which enables an open web structural support to be mounted flush with the top of an end support such as a support wall which may be provided with a bearing plate, and reduces the load carried by the chord members by better transferring load carried by the end web member to the support wall.

It is a further object of the present invention to provide such a mounting bracket apparatus which enables the length of an open web structural support to be adjusted by such apparatus and thereby accommodating different length chord members.

An additional object of the present invention is to provide a spacer apparatus for such a mounting bracket apparatus which is adjustable enabling the length of the open web structural support member to be adjusted without removing the structural support member from the support wall.

It is still a further object of the present invention to provide such an adjustable spacer apparatus whereby the width of the apparatus is changed in a simple matter by turning a threaded element.

Still another object of the present invention is to provide such an adjustable spacer apparatus capable of carrying a compression load.

Another object of the present invention is to provide an adjustable web member for an open web structural support for enabling the length of the structural support to be changed.

It is still a further object of the present invention to provide such an adjustable web member capable of carrying compression and tension loads.

The foregoing and other objects, features, and advantages of the present invention will become more readily apparent from the following detailed description of preferred embodiments which proceeds with reference to the accompanying drawings.

BRIEF DESCRIPTION OF THE DRAWINGS

FIG. 3 is a perspective view of the mounting bracket apparatus employed in the apparatus of FIGS. 1 and 2 before it is folded for assembly.

FIG. 4 is a top view of a piece of sheet metal cut to be used to form the bracket apparatus of FIG. 3, with the fold lines for so forming being shown as dashed lines.

FIG. 5 is an enlarged perspective rear view of the web connection portion of the bracket apparatus of FIG. 1.

FIG. 6 is a perspective rear view of the web connection portion of FIG. 5 with a web member connected thereto, the end of the web member being shown in phantom.

FIG. 7 is a perspective view of an adjustable spacer apparatus shown in a fully contracted position.

FIG. 8 is a perspective view of the adjustable spacer apparatus of FIG. 7 shown in an extended position.

FIG. 9 is an exploded view of the components which effect the extension and retraction of the adjustable spacer apparatus.

FIG. 10 is a perspective view of a first bearing member of the adjustable spacer apparatus.

FIG. 11 is a perspective view of a second bearing member of the adjustable spacer apparatus.

FIG. 12 is a section view of a top end portion of the length adjustable web member of FIGS. 1 and 2.

DETAILED DESCRIPTION OF PREFERRED EMBODIMENTS

Figure 1:
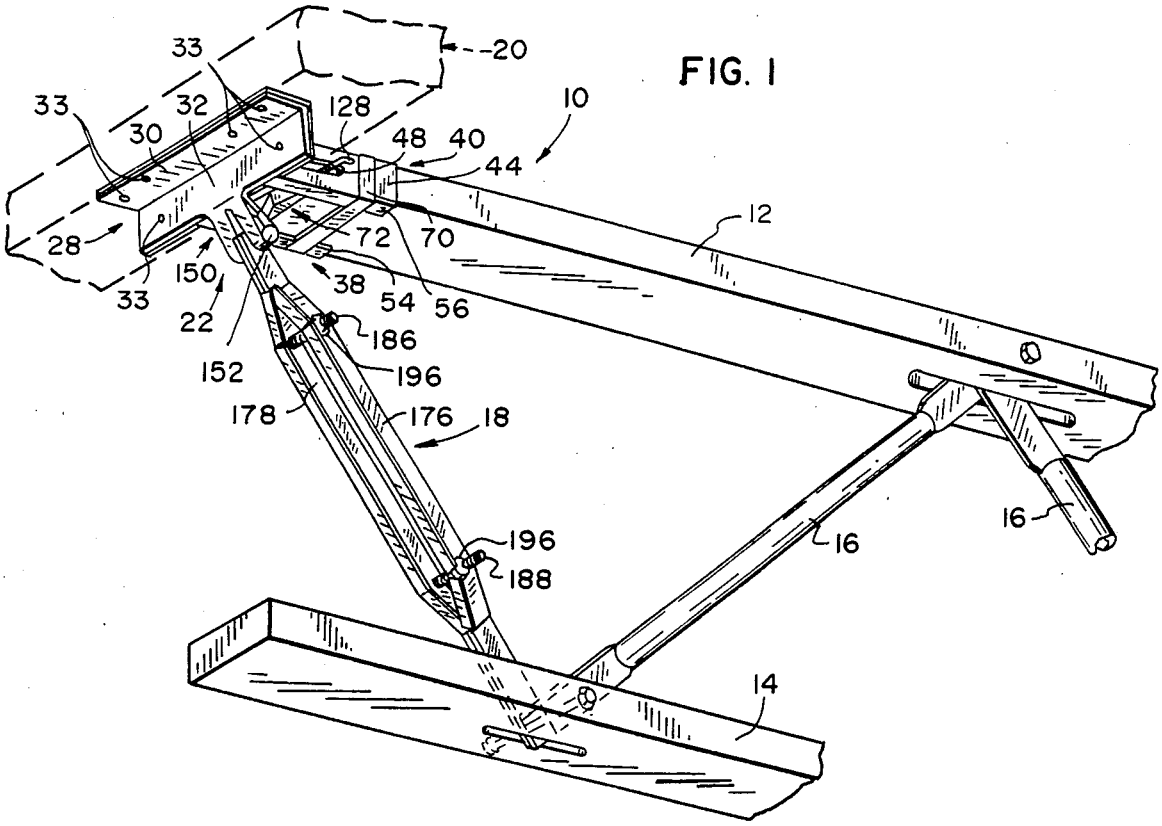
FIG. 1 is a perspective bottom view of an open-web truss apparatus including a mounting bracket, length adjustable end web member, and adjustable spacer apparatus in accordance with the invention.
Figure 2:
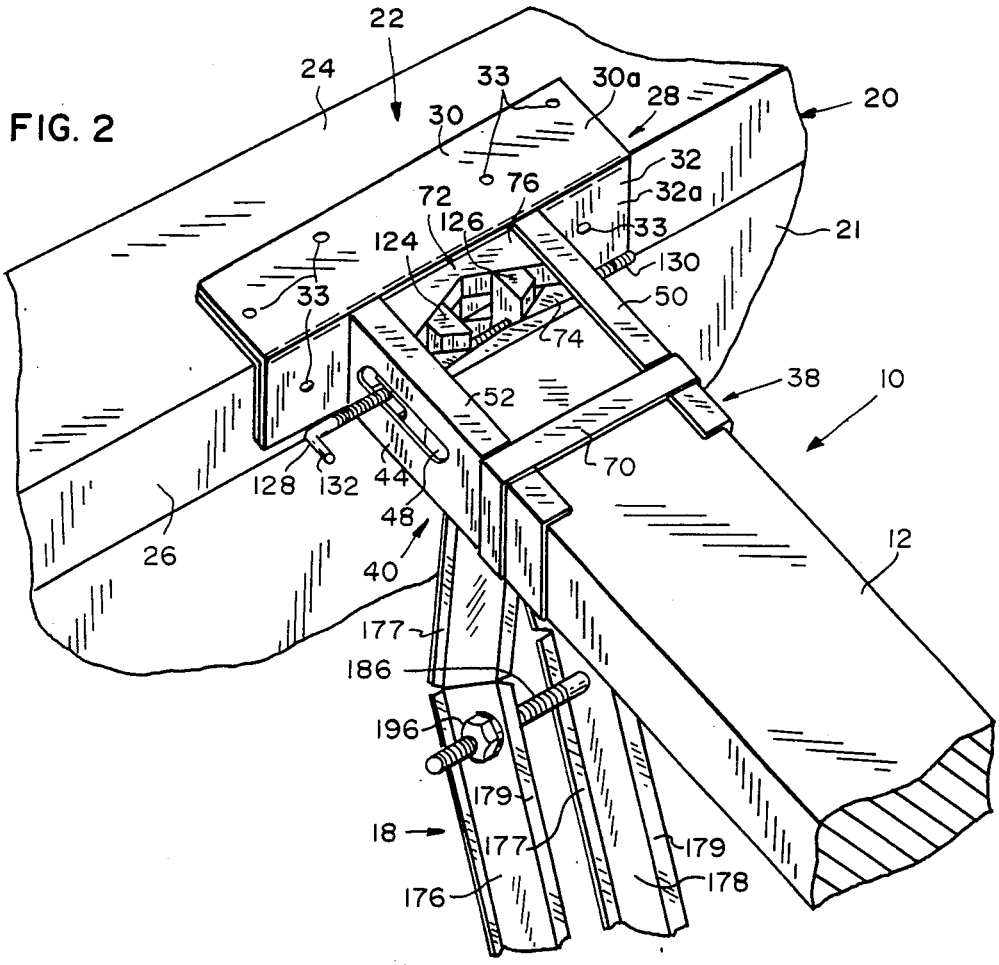
FIG. 2 is a perspective top elevation view of the upper chord member of the truss apparatus of FIG. 1 mounted to a bearing plate on top of a support wall in accordance with the invention.

FIGS. 1 and 2 show an open web structural support such as an open web truss apparatus 10 which includes an upper chord member 12 and a lower chord member 14. A plurality of web members 16 interconnect the upper and lower chord members and includes an end web member 18 provided on at least one end of the truss apparatus. End web member 18 includes web adjustment means for adjusting its length. This is accomplished by also adjusting the overall width of end web memeber 18, the method and purposes of which are shown in FIGS. 1 and 12 and more fully described below.

Truss apparatus 10 is affixed to end supports such as a bearing plate 20 preferably of wood mounted atop a concrete support wall 21 by bracket apparatus 22 which is attached to upper chord member 12. Bearing plate 20 is generally a rectangular board and includes a flat upper horizontal surface 24 and a front surface 26 which downwardly extends from surface 24.

Bracket apparatus 22 includes support plate means in the form of an L-shaped plate member 28 having an elongate first portion 30 generally parallel to the length of upper chord member 12 and an elongate second portion 32 generally perpendicular to the same upper chord member length and first portion 32. The underside of first portion 30 is adapted to bear against upper horizontal surface 24 of bearing plate 20 while the underside of second portion 32 is adapated to bear against front surface 26. Holes 33 are provided in portions 30, 32 for receiving nails or screws (not shown) when affixing the apparatus to bearing plate 20. When bearing plate 20 is made of metal such as steel, bracket apparatus 22 can be affixed thereto by welding. In this manner, plate member 28 is adapted to be secured at the top of a support wall for transferring load from the truss to the support wall.

Referring to FIGS. 1–4, bracket apparatus 22 is formed by folding a piece of sheet metal cut in accordance with FIG. 4 about the dashed fold lines. As shown in FIG. 3, angular plate member 28 is comprised of two overlapping plate members: an upper member 34 which overlaps a lower member 36. The two portions of members 34, 36 which together form portions 30, 32 are depicted as 30*a*, 32*a* respectively and as 30*b*, 32*b* respectively.

Plate member 34 includes outwardly extending receiving means in the form of two generally perpendicularly extending channel members 38, 40 which receive and support therebetween the end of upper chord member 12. As shown, channel members 38 and 40 each receive a different one of the opposite side edges of the end of upper chord member 12. In this manner, plate member 28 cooperating with channel members 38, 40 enables the top of truss apparatus 10 to be mounted flush with the top of bearing plate 20 on the support wall. Also, the receiving means in the form of channel members 38, 40 is adapted to receive different length upper chord members in that the channel members slidably receive the upper chord member.

Channel members 38 and 40 include side portions 42, 44 respectively, each having an elongated rearward positioned slot 46, 48 respectively, for an adjustable spacer control hereafter described. Each channel member 38, 40 has a top flange portion 50, 52 respectively, extending inwardly from the top edges of side portions 42, 44 and a bottom flange portion 54, 56 respectively, which extend inwardly from bottom edges of plate portions 42, 44 respectively. Thus, portions 50, 42, 54 of member 38 and portions 52, 44 and 56 of member 40 define a channel area which receives upper chord member 12.

Top flange portions 50, 52 include tab portions 58, 60 respectively, which are welded to the face of first portion 32a of plate member 34 for rigidly affixing channel members 38, 40 thereto.

The channel members also include fastening means for fastening upper chord member 12 to the channel members. The fastening means is in the form of slots 62, 64 and 66, 68 near the outermost ends of each of flange portions 50, 54, 52, and 56 of channel members 38, 40 respectively. The fastening means further includes a band member 70 which extends through such slots and around the sides 42 and 44 of channel members 38, 40 and upper chord member 12, as shown in FIGS. 1 and 2. The fastening means serves to hold channel members 38, 40 against the side edges of upper chord member 12 and prevents the channel members from spreading outward. In another aspect of the invention (not shown), the fastening means could comprise holes in the side portions 42 and 44 of the channel members, the holes receiving a fastening element such as a threaded bolt which extends through a laterally extending hole in the upper chord member and receives a nut for securing the upper chord member to the channel members.

Referring to FIGS. 5 and 6, bracket apparatus 22 further includes connection means for connecting the angular plate member to end web member 18. Such connection means is a connector member 150 in the form of generally angular downwardly extending connecting portions 151*a* and 151*b* secured to the bottom of bracket portions 32*a* and 32*b*. The connector member 150 receives a securing pin 152 which extends through the upper end of adjustable end web member 18 and through the connector member. The connector member includes a slot 154 through connecting portions 151*a* and 151*b* to provide a space for receiving the upper end of web member 18. Connector member 150 is comprised of a singular pin receiving portion 156 rounded about one end 158 formed by connecting portions 151*a* and 151*b* at 160 where they join angle members 34, 36. The connecting portions include inwardly directed reinforcing tabs 162, 164, 166, 168. The rounded end portion 158 includes rounded outwardly projecting locking portions 170, 172 which are bent after insertion of the pin 152 to hold such pin in the connector member 150. The bottom portions of members 162, 164, 166, 168 and the rounded portions of locking members 170, 172 create a rounded passage 174 which extends through end portion 158 of connecting member 150 for receiving securing pin 152. When pin 152 is so received in passaage 174 and passes through the end of web member 18, the end portions of locking members 170, 172 extending past the ends of pin 152 are crimped over the ends of pin 152 to keep the same within passage 174, as shown in FIG. 6.

By connecting end web member 18 directly to bracket apparatus 22 instead of the upper chord member, a portion of the load carried by the web members is more directly transferred to the support wall. Were such web member instead connected to the upper chord, a portion of the load carried by the end web member would be transferred through the upper chord to the support wall. Attaching the end web member to bracket apparatus 22 has the effect of more efficiently transferring load from the end web member directly to the support wall.

Referring to FIGS. 2 and 7–11, truss apparatus 10 includes adjustment means for adjusting the length of the truss apparatus by moving the upper chord member within channel members 38, 40. The adjustment means as shown is in the form of an adjustable spacer apparatus 72 positioned within the channel members between the end of upper chord member 12 and plate member 32 of angular plate member 28. Adjustable spacer 72 includes a first bearing member 74 and a second bearing member 76.

As shown in FIG. 10, bearing member 76 is comprised of a plate-like portion 78, one side of which has a flat outer surface 80 and a double sloping inner surface 82 opposite surface 80 which is generally roof shaped but includes wedge-like projecting portions 84, 86. Wedge portions 84, 86 include inwardly tapered side surfaces 88, 90 respectively, which join along a line 92 at the peak of sloping surface 82. Each of wedges 84, 86 includes a central slot 94, 96 respectively, which extends from outer end edges 93 and 95 inwardly to respective inwardly tapered surfaces 88, 90.

Referring to FIG. 11, first bearing member 74 includes an outer bearing surface 98 on one side which includes upper corner recessed portions 100, 102 that provide space for receiving tab portions 60, 58 respectively, of channel members 38, 40 when adjustable spacer apparatus 72 is installed within channel members 38, 40. An inner surface 103 is provided opposite bearing surface 98 and four wedge-like projections 104, 106, 108, 110 project outward from such inner surface. The projections 104, 106, 108 and 110 have inwardly sloping surfaces 112, 114, 116, 118 respectively. These surfaces slope inward from end portions to an intersection line 120 in the center of member 74. Wedge-like projection pairs 104, 106 and 108, 110 are separated to provide a central channel 122 which receives wedge portions 84, 86 of second bearing member 76 when members 74 and 76 are assembled, as shown in FIG. 7.

Adjustable spacer apparatus 72 also includes two separate wedge-shaped cam members 124, 126 which are positioned between sloping surfaces 88, 90 of second bearing member 76 and sloping surfaces 112, 114, 116, 118 of first bearing member 74 when bearing members 74 and 76 are assembled. As shown in FIGS. 7 and 8, movement of cam members 124, 126 toward or away from each other causes first and second bearing members 74, 76 to move toward or away from each other thereby adjusting the width of spacer member 72. Control means for effecting this movement is provided in the form of a threaded control rod 128 which includes a threaded shaft 130 and a handle portion 132 extending from the threaded portion at an angle of apaproximately 90 degrees for use in turning the shaft. A recessed portion 134 of smaller diameter than the threaded shaft portion is included near the end of the shaft to hold a keeper member 146 as more fully described below.

Each cam member 124, 126 includes a hole 136, 138 respectively, which extends laterally therethrough. Rectangular slots 140, 142 are provided in side edges of each wedge member 124, 126 respectively, and extend to holes 136, 138. Holes 136, 138 extend roughly through the center of the slots. Slot 142 in wedge member 126 receives a threaded nut 144 while slot 140 of wedge member 126 receives keeper member 146. Threaded portion 130 of control rod 128 extends through holes 138, 136, nut 144 and keeper 146. Keeper 146 has a slot-like portion 148 having a dimension approximating the dimension of recessed portion 134 of rod 128 for slidably receiving the same, but not of a dimension great enough to receive threaded portion 130. In this manner, as rod 128 is rotated, wedge member 126 is forced toward or away from wedge member 124 along threaded shaft 130 depending on the direction of rotation. As an alternative embodiment (not shown), keeper 146 could be replaced with a nut having threads reversed from the direction of the threads in nut 144 for providing an effect similar to a turnbuckle. Therefore, cam members 124 and 126 will move toward or away from each other along threaded portion 130 as rod 128 is rotated. Holes 136, 138 in wedge members 124, 126 respectively, could also be oppositely threaded for threadedly receiving portion 130, thus eliminating the need for nuts, a keeper and slots.

Adjustable spacer 72 is positioned within channel members 38, 40 as shown in FIG. 2. Rod 128 extends through slots 46, 48 in side portions 38, 40 of the channel members for adjustment of the spacer. Slots 46, 48 are elongated in the direction of the length of upper chord member 12 to pemit rod 128 to move laterally as the width of the spacer is adjusted.

As end web member 18 is fixed with respect to angled plate member 28 by connecting member 150, means are provided for correspondingly adjusting the length of end web member 18 to accommodate different length upper chord members. Such an end web member 18 having means for adjusting its length is shown in FIGS. 1, 2, and 12.

Web member 18 is comprised of two facing narrow, elongated strip members 176, 178. Each strip member has a central portion 180 and two end portions 182 which are inwardly angled from the respective central portions as shown in FIG. 12. Each strip member 176, 178 is shown as generally 'z' shaped in lateral cross section including elongate opposite edge portions 177, 179 which extend perpendicularly outward in opposite directions. Edge portions 177, 179 enable the end web member to withstand compression as well as tension loads.

The end portions 182 of each strip member 176, 178 include a hole 184 extending therethrough, such holes being aligned with each other when end portions 182 are joined. The two end portions of each facing strip member are joined to each other by stamping to form hollow rivets at holes 184 which join ends 182 of strips 176 and 178 together. When the end portions 182 are so configured, central portions 180 are spaced apart from each other. Holes 184 in each joined end portion receive a connector element such as pin 152 for joining the end web member to connector member 150, or for a pin which extends laterally through side edges of the chord members of the truss.

The length of web member 18 is changed by causing the central portions 180 of each member 176, 178 to move toward or away from each other which accordingly has the effect of also adjusting the length and overall width of the end web member. Means for moving central portions 180 toward or away from each other to adjust the spacing therebetween is accomplished by means of threaded adjustment elements such as bolts 186, 188. Bolts 186, 188 extend through holes 190, 192 positioned near opposite ends of the central portions 180 of each strip member 176, 178. Bolts 186, 188 are received in a threaded opening in the central portion of strip member 176 and the end of the bolt engages the central portion of strip member 178 whereby when the bolts are turned, the central portions move toward or away from each other. The threaded opening as shown is provided by a pair of threaded nuts 194, 196 which align with holes 190, 192 and are welded to the opposite sides of member 176.

The above described apparatus has the advantage of permitting the length of an open web-type structural support to be adjusted while the support is mounted in position without disassembling the support.

Having illustrated and described the principles of my invention with reference to preferred embodiments, it should be apparent to those persons skilled in the art that such invention may be modified in arrangement and detail without departing from such principles. I claim as my invention all such modifications as come within the true spirit and scope of the following claims.

I claim:

1. A structural support apparatus of the open web type comprising, an upper chord member;

a lower chord member;

a plurality of web-members interconnecting said chord members and including at least one length adjustable end web member;

mounting bracket means for mounting the top of the upper chord member at substantially the same level as an end support to which the bracket means is attached, said bracket means extending laterally of said upper chord member length and adapted to be secured at the top of said end support for transferring load from the structural support apparatus to the end support;

said bracket means including outwardly extending chord receiving means for receiving and supporting an end of the upper chord member whereby said bracket means enables the top of the structural support apparatus to be mounted flush with the top of the end support, said receiving means being adapted to receive different length upper chord members;

connection means for connecting the bracket means to said length adjustable end web member; and adjustment means for adjusting the length of said end web member by an adjustment movement transverse to said length.

2. The apparatus of claim 1 wherein the bracket means includes an angular plate member having an elongate first portion generally parallel to said upper chord member length and an elongate second portion generally perpendicular to said upper chord member length and first portion, said first portion adapted to be attached to a top surface of said end support, said second portion adapted to be attached to a side surface of said end support perpendicular to said top surface, and said connection means including a connector member extending below and outwardly from said second portion away from said end support.

3. The apparatus of claim 1 wherein said receiving means includes two generally perpendicularly extending channel members which receive opposite side edges of said upper chord member.

4. The apparatus of claim 3 including fastening means for fastening said upper chord member to said channel members.

5. The apparatus of claim 4 wherein said fastening means includes a band member which extends around said channel members and upper chord member.

6. The apparatus of claim 1 wherein the web adjustment means adjusts the length of said end web member by also adjusting the width of said end web member.

7. The apparatus of claim 1 wherein said length adjustable end web member comprises two elongate and facing strip members, each strip member having a central portion and two end portions, the two end portions of each strip member being joined to each other, and the central portions of the strip members being spaced apart from each other;

each strip member including holes in the end portions axially aligned with holes in the end portions of the other strip member for receiving fastening elements; and adjustment means for moving the central portions of each strip member toward or away from each other to adjust the spacing between said strip members whereby the length of the web member is changed.

8. The apparatus of claim 7 wherein said adjustment means in said length adjustable end web member includes a threaded rod received in a threaded opening in one of said central portions whereby when said rod is turned, said central portions move toward or away from each other.

9. The apparatus of claim 8 wherein said threaded opening is defined by at least one threaded nut welded to one of said central portions.

10. The apparatus of claim 7 wherein said web adjustment means in said length adjustable end web member includes a pair of threaded bolts received in and through said central portions, said threaded bolts being received in threaded nuts affixed to one of said central portions whereby when said bolts are turned, said central portions move towarad or away from each other.

11. The apparatus of claim 1 wherein said connection means includes a generally angular downwardly extending connecting member which receives a pin which extends through an end of said adjustable end web member and through said connecting member.

12. A bracket apparatus for supporting a structural support of the open web type having an upper chord member and a lower chord member interconnected by wet members, the bracket apparatus comprising, mounting means having an elongate first portion and an elongate second portion extending laterally to the first portion, for mounting said open web structural support on the top of an end support so that the top of the upper chord member is at substantially the same level as said end support;

receiving means extending outward from said second portion, for receiving and supporting an upper chord member of the structural support whereby said mounting means enables the end of the top of a structural support to be mounted flush with the top of said end support;

connection means for connecting the second portion to an end web member by a connector member extending below and outwardly from said second portion of said mounting means and away from said end support.

13. The apparatus of claim 12 wherein said receiving means includes two generally perpendicularly extending channel members adapted to receive opposite side edges of said upper chord member, said channel members being adapted to receive different length upper chord members.

14. The apparatus of claim 12 wherein said connection means includes a connector member extending downward from the second portion and having a pin receiving passage for holding a pin extending through said end web member.

15. A web member apparatus of adjustable length for a structural support of the open web type having an upper and lower chord member interconnected by web members, comprising, two elongate and facing strip members, each strip member having a central portion and two end portions, the two end portions of each facing strip member being joined to each other, and the central portions of the facing strip members being spaced apart from each other;

each said strip member including holes in the end portions axially aligned with holes in the end portions of the other strip member for receiving fastening elements; and web adjustment means for moving the central portions of each strip member toward or away from each other to adjust the spacing between said strip members whereby the length of the web member is changed.

16. The apparatus of claim 15 wherein each strip member includes oppositely directed edge portions for enabling the web member apparatus to support compression and tension loads.

17. The apparatus of claim 15 wherein said web adjustment means includes at least one threaded adjustment element received in a threaded opening in one of said central portions whereby when said adjustment element is turned said central portions move toward or away from each other.

18. The apparatus of claim 15 wherein said web adjustment means in said length adjustable end web member includes a pair of threaded bolts received in and through said central portions, said threaded bolts being received in threaded nuts affixed to one of said central portions whereby when said bolts are turned, said central portions move toward or away from each other.

* * * * *

UNITED STATES PATENT AND TRADEMARK OFFICE

CERTIFICATE OF CORRECTION

PATENT NO. : 4,682,460

DATED : July 28, 1987

INVENTOR(S) : WILLIAM R. REETZ

It is certified that error appears in the above-identified patent and that said Letters Patent is hereby corrected as shown below:

In the Specification

Column 1, line 44, "matter" should be --manner--.

Column 2, line 42, "memeber" should be --member--.

Column 4, line 17, "passaage" should be --passage--.

Column 5, line 16, "apaproximately" should be --approximately--.

Column 5, line 19, "portion is" should be --portion 130 is--.

In the Claims:

Claim 12, line 6, "wet" should be --web--.

Signed and Sealed this

Sixteenth Day of February, 1988

*Attest:*

*Attesting Officer*

DONALD J. QUIGG

*Commissioner of Patents and Trademarks*